US006896847B2

(12) United States Patent
Sandberg et al.

(10) Patent No.: US 6,896,847 B2
(45) Date of Patent: May 24, 2005

(54) STEEL ALLOY PLASTIC MOULDING TOOL AND TOUGH-HARDENED BLANK FOR PLASTIC MOULDING TOOLS

(75) Inventors: Odd Sandberg, Uddeholm (SE); Maganss Tidesten, Hagfors (SE)

(73) Assignee: Uddeholm Tooling Aktiebolage, Hagfors (SE)

( * ) Notice: Subject to any disclaimer, the term of this patent is extended or adjusted under 35 U.S.C. 154(b) by 104 days.

(21) Appl. No.: 10/276,854

(22) PCT Filed: May 11, 2001

(86) PCT No.: PCT/SE01/01026

§ 371 (c)(1),
(2), (4) Date: Nov. 20, 2002

(87) PCT Pub. No.: WO01/96626

PCT Pub. Date: Dec. 20, 2001

(65) Prior Publication Data

US 2004/0101430 A1 May 27, 2004

(30) Foreign Application Priority Data

Jun. 15, 2000 (SE) ..... 0002250

(51) Int. Cl.[7] ..... C22C 38/44; C22C 38/46
(52) U.S. Cl. ..... 420/69; 148/325; 148/326
(58) Field of Search ..... 148/325, 326; 420/69, 42, 92

(56) References Cited

U.S. PATENT DOCUMENTS 3,767,390 A * 10/1973 Hahn ..... 420/69
5,503,797 A 4/1996 Zoch et al.
5,641,453 A 6/1997 Hackl et al.
5,714,114 A 2/1998 Uehara
5,779,821 A 7/1998 Ishii et al.
6,193,469 B1 2/2001 Tsuda et al.
6,235,237 B1 5/2001 Osing et al.

FOREIGN PATENT DOCUMENTS

| | | |
|---|---|---|
| DE | 197 12 381 A1 | 1/1998 |
| EP | 0 639 691 A1 | 2/1995 |
| EP | 0 867 522 A2 | 9/1998 |
| EP | 0 639 691 B2 | 12/2000 |
| EP | 0 92 944 B1 | 6/2002 |
| JP | 56-116858 | 9/1981 |
| JP | 10-110248 | 4/1998 |
| WO | WO 96/21747 | 7/1996 |

OTHER PUBLICATIONS

Novotny, P.M. et al; "Corrosion Resistant, Martansitic Steel Alloy"; Specification; *Taiwan Patent Publication* No. 289053 (23 pgs), Aug. 1996.

* cited by examiner

*Primary Examiner*—Deborah Yee
(74) *Attorney, Agent, or Firm*—Nixon & Vanderhye

(57) ABSTRACT

A steel alloy has a chemical composition which contains in weight-%, 0.16–0.27 C, 0.06–0.13 N, wherein total content of C+N shall satisfy the condition, 0.3<C+N<0.4, 0.1–1.5 Si, 0.1–1.2 Mn, 12.5–14.5 Cr, 0.5–1.7 Ni, 0.2–0.8 Mo, 0.1–0.5 V. The steel is suitable for plastic molding tools.

22 Claims, 9 Drawing Sheets

STEEL ALLOY PLASTIC MOULDING TOOL AND TOUGH-HARDENED BLANK FOR PLASTIC MOULDING TOOLS

TECHNICAL FIELD

Then invention relates to a steel alloy and particularly to a steel alloy for the manufacturing of plastic moulding tools. The invention also concerns plastic moulding tools made of the steel and tough hardened blanks of the steel alloy for the manufacturing of plastic moulding tools.

BACKGROUND OF THE INVENTION

Plastic moulding tools are made of a great variety of steel alloys, such as carbon steels, low and medium alloyed steels, martensitic stainless steels, precipitation hardening steels and maraging steels. A summary of existing steel alloys which are employed for the manufacturing of plastic moulding tools can be found in the printed issue of "Tool Steels in the next Century, Proceedings of the $5^{th}$ international Conference on Tooling, Sep. 29 to Oct. 1, 1999, University of Leoben" (ISBN:3-9501105-0-X) page 635–642. Within the group of martensitic stainless steels there exist a number of commercial plastic moulding steels, including a steel that is manufactured and marketed by the applicant under the registered trade name STAVAX ESR® having the following nominal chemical composition in weight-%: 0.38 C, 0.8 Si, 0.5 Mn, 13.6 Cr, 0.3 V, balance iron and unavoidable impurities from the manufacturing of the steel. That steel is standardized according to SIS2314 and AISI420. Steel of this type has an adequate hardness in the hardened and tempered condition of the steel. The ductility (toughness) and the hardenability, however, do not satisfy the increasingly higher demands which are raised on the materials of today for qualified plastic moulding steels, at least not for tools in large dimensions.

DISCLOSURE OF THE INVENTION

It is a purpose of the invention to provide a martensitic, stainless steel for plastic moulding tools having the same good features as STAVAX ESR® but an improved hardenability, i.e. capacity to be hardened also in large dimensions, and improved ductility (toughness). This can be achieved if the steel has the chemical composition which is stated in the appending patent claims.

As far as the importance of the individual elements, and the cooperation of the alloy elements of the steel, are concerned, the following may be said to apply without binding the claimed patent protection to any specific theory.

Carbon and nitrogen are elements which have great importance for the hardness and ductility of the steel. Carbon also is an element which is important for improving the hardenability. At the manufacturing of said steel of type SIS2314/AISI420 great segregation variations between different manufactured bars and also within individual bars can be found. Also great hardenability variations between different heats can occur. This has to do with how much of the content of carbide forming elements of the steel that is bound in the form of in the first place carbides. I.a from this reason and particularly in order to counteract the formation of unfavourable carbides in the form of chromium carbides ($M_7C_3$ carbides) the steel of the invention contains not more than 0.27% C, preferably not more than 0.25% C. The minimal content of carbon in the steel is 0.18% in order that the steel shall get a sufficient amount of dissolved carbon in the martensite, so that the martensite in as tempered condition shall get a hardness of at least 50 HRC, suitably 50–54 HRC. Carbon also has a favourable hardenability promoting effect. Preferably, the carbon content of the steel is at least 0.20%.

The nitrogen contributes to the achievement of a more even, more homogenous distribution of carbides and carbonitrides by changing the solidification conditions of the alloy system so that coarser carbide aggregates are avoided or are reduced during the solidification. The amount of $M_{23}C_6$ carbides also are reduced in favour of M (C,N), i.e. vanadium carbonitrides, which have a favourable effect on the ductility/toughness. To sum up, the nitrogen contributes to provide a more favourable solidification process with smaller carbides and nitrides, which can be broken down to a more finely dispersed phase during working. From these reasons, nitrogen shall exist in an amount of at least 0.06% but not more than 0.13%, at the same time as the total amount of carbon and nitrogen shall satisfy the condition $0.3 \leqq C+N \leqq 0.4$. In the expression, weight-% are referred to. In the hardened and tempered steel, nitrogen substantially is dissolved in the martensite to form nitrogen martensite in solid solution and therein contribute to the desired hardness. Generally speaking, as far as the amount of nitrogen is concerned, said element shall exist in an amount of at least 0.06% in order together with carbon to form carbonitrides, M (C, N), to a desired degree, be present as a dissolved element in the tempered martensite in order to contribute to the hardness of the martensite, act as an austenite former, and contribute to a desired corrosion resistance by increasing the so called PRE value of the matrix of the steel, but not exceed max 0.13% in order to maximize the content of carbon+nitrogen, where carbon is the most important hardness former.

Silicon increases the carbon activity of the steel and consequently the tendency of precipitation of major primary carbides. Therefore it is desirable that the steel has a low silicon content. Besides, silicon is a ferrite stabilizing element, which is an unfavourable feature of silicon. As the steel moreover has a comparatively high content of chromium and molybdenum, which also are ferrite stabilizing elements, the content of silicon should be limited in order that the steel shall not get ferrite in its matrix. The steel therefore must not contain more than 1.5% Si, preferably max. 1.0% Si. Generally, the ferrite stabilizing elements shall be adapted to the austenite stabilizing ones. However, silicon exists as a residue from the desoxidation treatment, wherefore the optimal content of silicon lies within the range 0.1–0.5% Si, possibly not more than 0.4% Si, nominally about 0.3% Si.

Manganese is a hardenability promoting element, which is a favourable effect of manganese, and is employed also for sulphur removal by forming harmless manganese sulphides. Manganese therefore is present in an amount of at least 0.1%, preferably at least 0.3%. Manganese, however, has a co-segregation effect together with phosphorus, which may cause tempering brittleness. Manganese therefore must not exist in amount of more than 1.2%, preferably max. 1.0%, suitably max 0.8%.

Chromium is the main alloy element of the steel and is essentially responsible for the stainless character of the steel, which is a vary important feature when the steel shall be used for plastic moulding tools with a good polishability. Chromium also promotes the hardenability. Since the steel has a low carbon content and also a low total content of carbon and nitrogen, any significant amounts of chromium are not bound in the form of carbides or carbonitrides, wherefore the steel may have as low chromium content as 12.5% and nevertheless obtain a desired corrosion resistance. Preferably, however, the steel contains at least 13% chromium. The upper limit is determined in the first place by the desired ductility (toughness) of the steel and by the tendency of chromium to form ferrite. Nor is it desirable that the steel has a too high content of chromium in order to counteract the formation of non-desirable amounts of chromium carbides and/or carbonitrides. The steel therefore must not contain more than at the most 14.5% Cr, preferably max. 14% Cr.

The steel of the invention may have as high vanadium content, 0.3%, as the reference steel STAVAX ESR® in order to provide a secondary hardening through the precipitation of secondary carbides during tempering and hence increasing the tempering resistance. Vanadium also acts grain growth inhibiting through the precipitation of MC carbides. If the vanadium content is too high there are, however, formed large, primary MC carbides at the solidification of the steel, and that also applies if the steel is subjected to ESR remelting, which primary carbides are not dissolved in connection with the hardening procedure. For the achievement of the desired secondary hardening and in order to provide a favourable contribution to the grain growth inhibiting, but at the same time prevent formation of large, undissolvable primary carbides in the steel, the vanadium content should lie in the range 0.1–0.5%. A suitable content is 0.25–0.40% V, nominally. 35% V.

Molybdenum shall exist in an active amount of at least 0.2% in the steel for the provision of a strongly hardenability promoting effect. Molybdenum also promotes the corrosion resistance up to a content of at least 1% Mo. At the tempering, molybdenum also contributes to increasing the tempering resistance of the steel, which is favourable. On the other hand, too much molybdenum may give rise to an unfavourable carbide structure through a tendency to precipitation of grain boundary carbides and segregations. Further molybdenum is a ferrite stabilizing element, which is unfavourable. The steel therefore shall have a balanced content of molybdenum in order to take advantage of its favourable effects but at the same time prevent those which are unfavourable. Molybdenum therefore should exist in an amount of 0.2–0.8%. Preferably, the content of molybdenum should not exceed 0.6%. An optimal content may lie in the range 0.3–0.4% Mo, nominally 0.35% Mo.

Nickel is a strong former of austenite and shall exist in an amount of at least 0.5% in order to contribute to the desired hardenability and toughness of the steel. Manganese, which also is a former of austenite, can not to any essential degree replace nickel in this respect, particularly as manganese may cause some, above mentioned drawbacks. The upper content of nickel is determined in the first place by cost reasons and is set to 1.7%. Suitably the steel contains 1.0–1.5% Ni, nominally 1.2% Ni.

The amount of chromium, molybdenum and nitrogen that is not dissolved in the matrix of the steel, i.e. not bound in the form of carbides, nitrides and/or carbonitrides, contributes to the corrosion resistance of the steel and takes part as factors in the so called PRE value of the steel, which is expressed by the following formula, in which Cr, Mo and N are the amounts of chromium, molybdenum and nitrogen that are dissolved in the matrix of the steel:

$$PRE = \%\ Cr + 3.3 \times \%\ Mo + 20 \times \%\ N$$

After hardening from 1030° C. and tempering at 250° C., 2×2 h, the PRE value of the matrix of the steel should be at least 14.8, preferably 15.0. After this heat treatment the hardness also shall be at least 50 HRC, preferably 50–54 HRC. The same hardness also should be achieved after high temperature tempering at 500° C., 2×2 h.

Best corrosion resistance and a very good toughness is achieved after low temperature tempering at about 250° C., but through this heat treatment internal stresses may be established in the steel, which can be released by spark machining in connection with the manufacturing of the plastic moulding tool.

At high temperature tempering at about 500° C. the stresses are released, which is favourable if the tool has such a complicated design that spark machining is required at the manufacturing of the steel. From these reasons, the steel shall obtain desired hardness after low temperature tempering as well as after high temperature tempering, which gives an option to provide a material which can have a good release of stresses prior to e.g. spark machining.

The steel of the invention shall also be possible to be supplied in tough hardened condition, which gives an option to manufacture the tool in very large dimensions through machining of a tough hardened blank. Through tempering at 540–625° C. or at about 575° C. it is thus possible to achieve a tough hardened material with a hardness of about 40 HRC (35–45 HRC), which is well suited to be machined. The hardening can be carried out by austenitizing at a temperature of 1020–1030° C., or about 1030° C., followed by cooling in oil, polymer bath or gas cooling in vacuum furnace. The high temperature tempering is performed at a temperature of 500–520° C. for at least one hour, preferably by double tempering, 2×2 h.

The steel also may contain an active content of sulphur, at least 0.025% S, in the case sulphur is added intentionally in order to improve the cuttability of the steel. This particularly concerns tough hardened material. In order to get best effect with reference to the cuttability improvement the steel may contain 0.07–0.15 S.

It is also conceivable that the steel may contain 0.025–0.15% S in combination with 3–75 ppm Ca, preferably 5–40 ppm Ca and 10–40 ppm O, wherein said calcium, which can be added as silicon calcium, CaSi, for globulizing of existing sulphides to form calcium sulphides, prevents the sulphides from getting a non-desired, elongated shape, which could impair the machinability. In this connection it should be mentioned that the steel, in its typical embodiment, does not contain any intentionally added sulphur.

The steel of the invention can be manufactured conventionally at a production scale by establishing a melt in the normal way, the melt having a chemical composition according to the invention, and casting the melt into large ingots or continuously casting the melt. Preferably electrodes are cast of the melt, which then are remelted by employing ESR technique (Electro Slag Remelting). It is, however, also possible to manufacture ingots, powder metallurgically by gas atomising the melt to form a powder, which then is compacted by a technique which can comprise hot isostatic compacting, so called HIP-ing, or alternatively manufacturing ingots by spray forming.

Further characteristic features and aspects as well as properties of the steel of the invention and its usefulness for the manufacturing of plastic moulding tools will be explained more in detail in the following through a description of performed embodiments and achieved results.

BRIEF DESCRIPTION OF DRAWINGS

In the following description of performed embodiments and achieved results, reference will be made to the accompanying drawings, in which.

EXAMINATION OF STEELS MANUFACTURED AT A LABORATORY SCALE

16 Q-ingots (50 kg laboratory heats) of steels having chemical compositions according to Table 1 were manufactured in three series. In the first series (Q9043–Q9062) ingots were manufactured having chemical compositions within a broad range. The variants of this first series which were considered to be most interesting were Q9050 and Q9062. The effect of Cr, Ni and Mo on the properties, however, needed to be examined further, wherefore a second series of Q-ingots (Q9103–Q9106) were manufactured in order to optimise the features obtained in the first series. In the third series of Q-ingots (Q9133–Q9134) the nitrogen content was increased at the cost of the carbon contents of the variants Q9103–Q9104. Q9043 has a chemical composition which lies within the frame of the manufacturing tolerances of STAVAX ESR® and is the reference material in the study.

The ingots were forged to dimension 60×40 mm, whereafter the bars were cooled in vermiculite. Soft annealing was carried out in a conventional mode according to normal practice for the commercial steel STAVAX ESR®.

Figure 1:
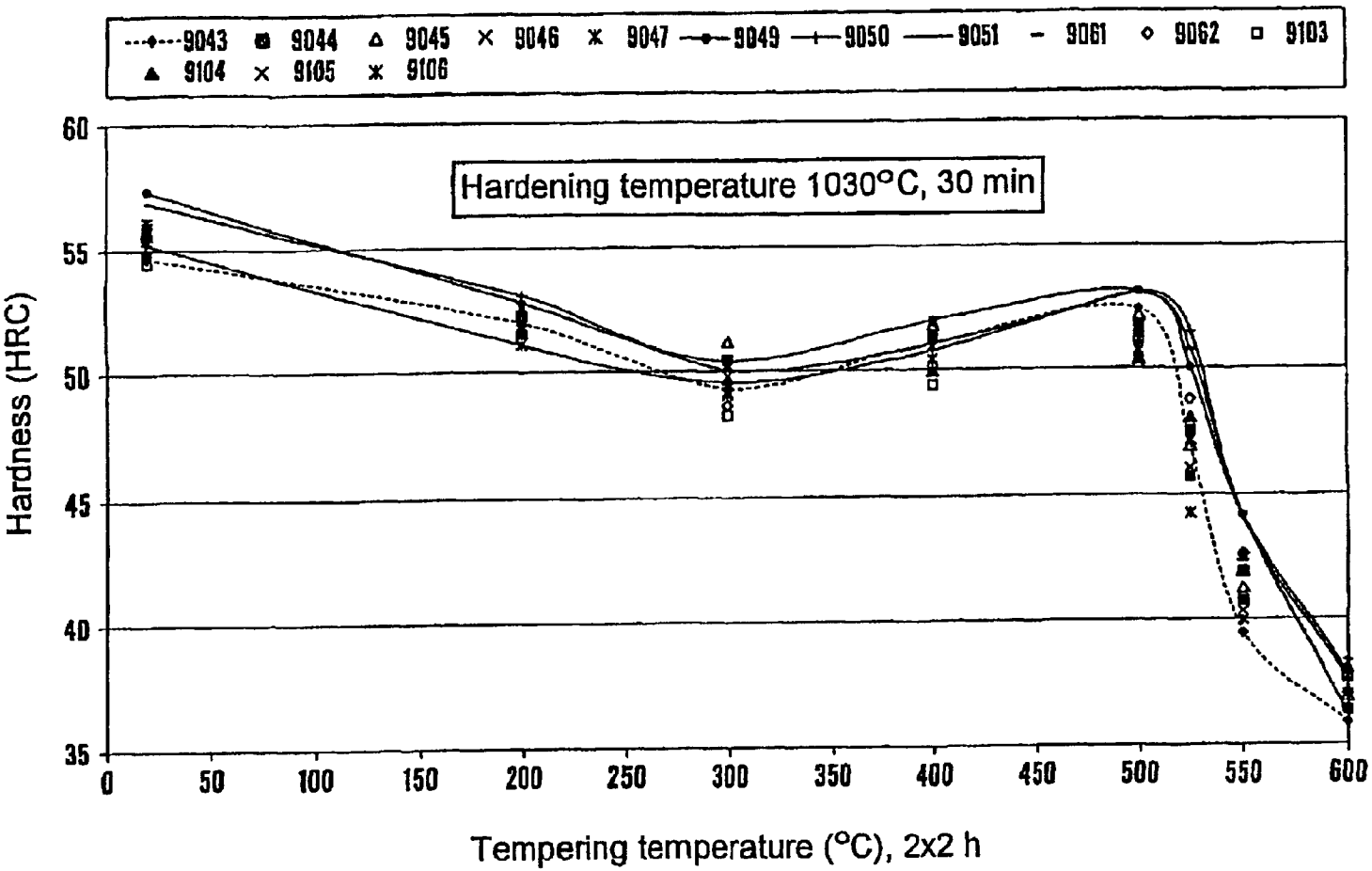
FIG. 1 shows tempering graphs of a first series of steel manufactured as so called Q-ingots (50 kg laboratory heats)
Figure 1A:
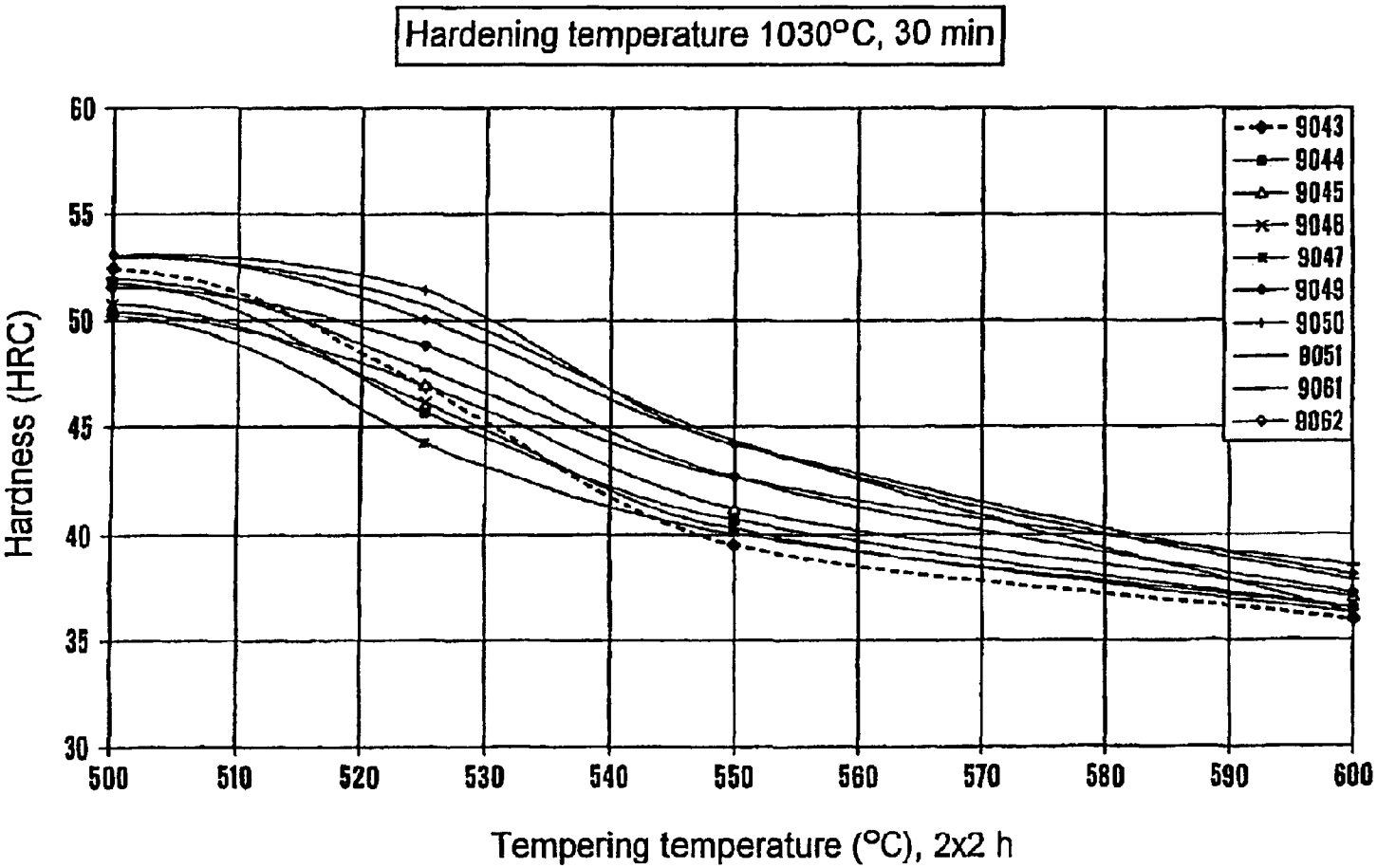
FIG. 1A shows the tempering graphs of FIG. 1 in the temperature range 500–600° C. at a larger scale.
Figure 2:
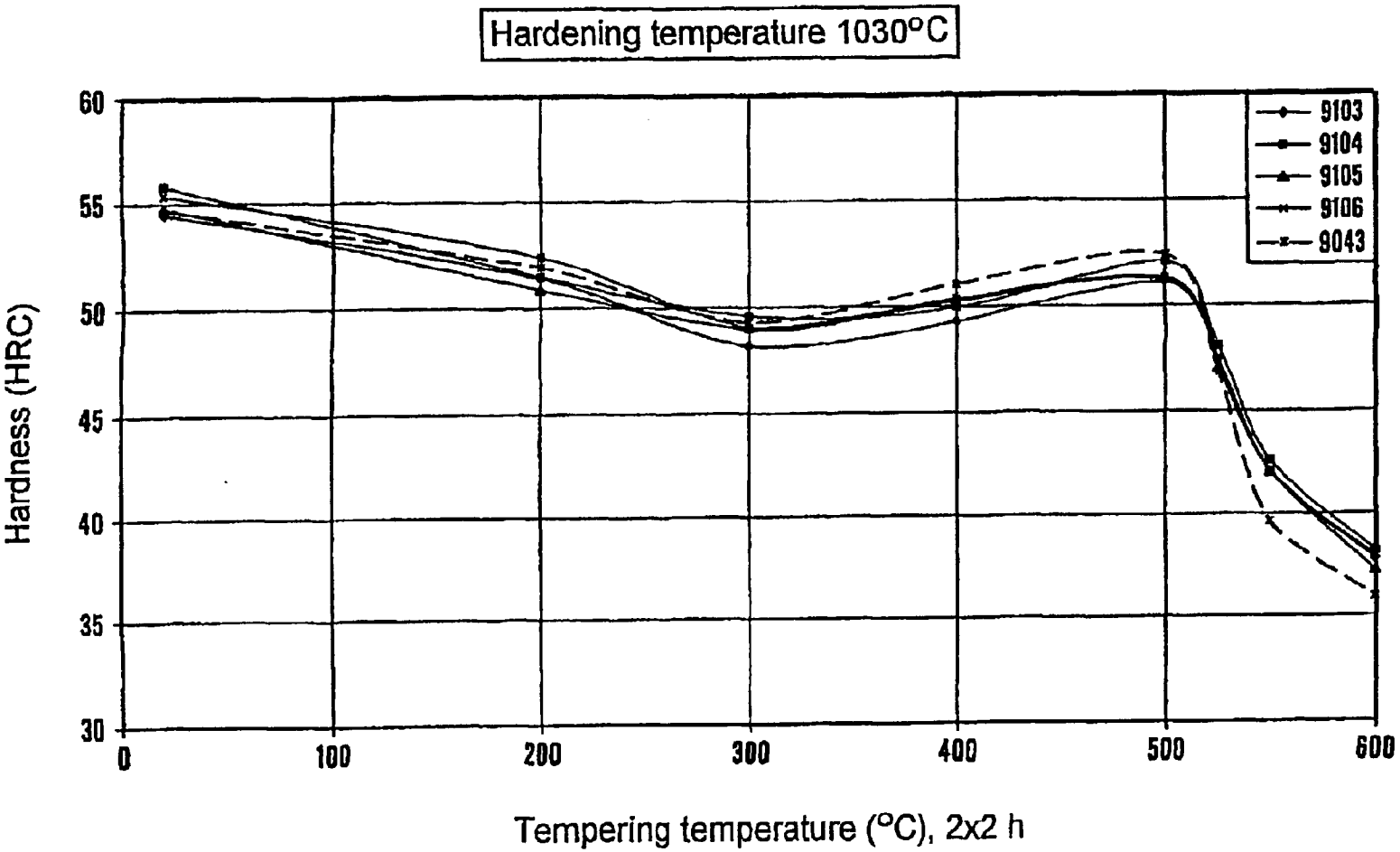
FIG. 2 shows tempering graphs of the reference material and of a second series of steels manufactured as Q-ingots.
Figure 2A:
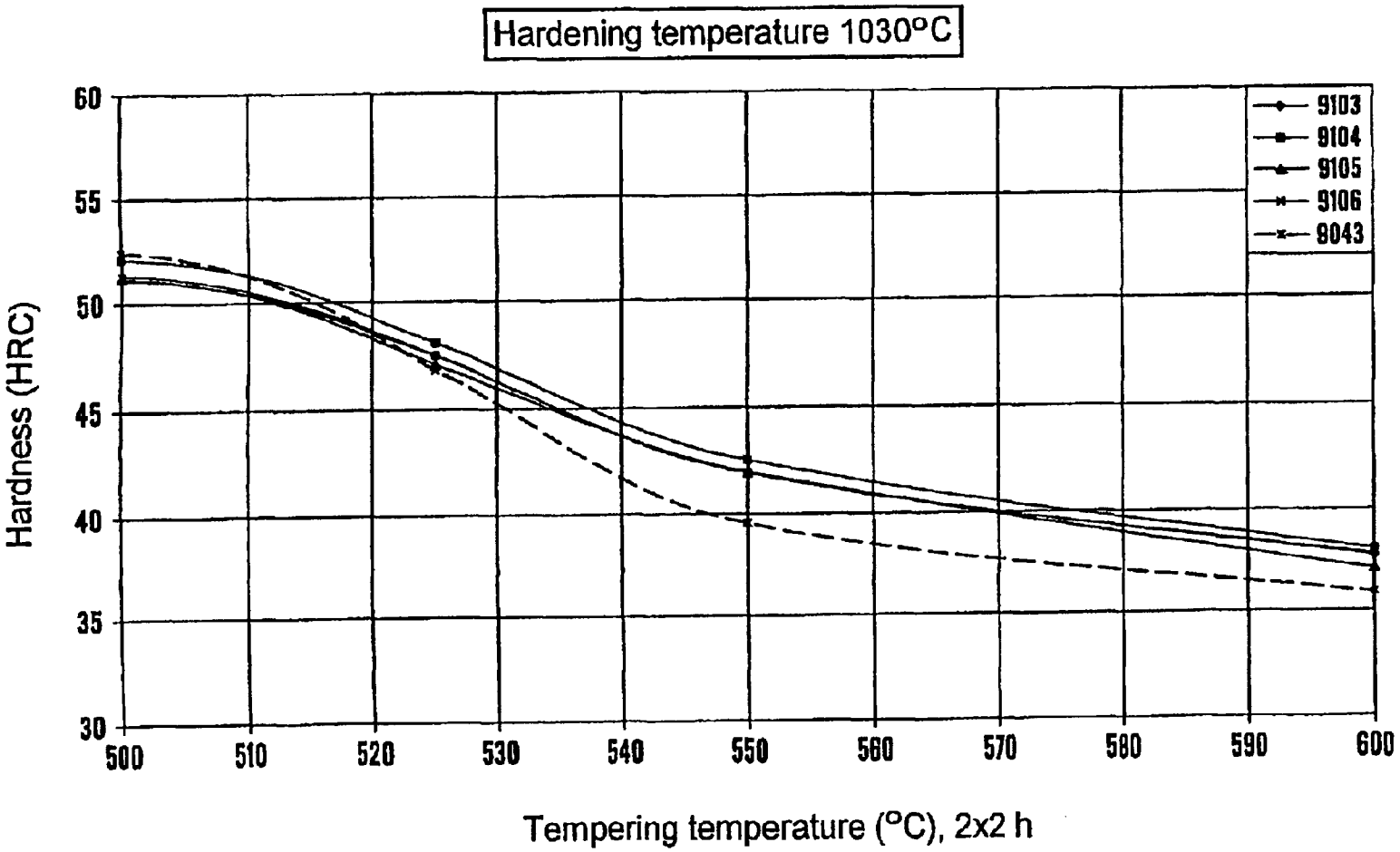
FIG. 2A shows the tempering graphs of FIG. 2 in the tempering temperature range 500–600° C. at a larger scale.
Figure 3:
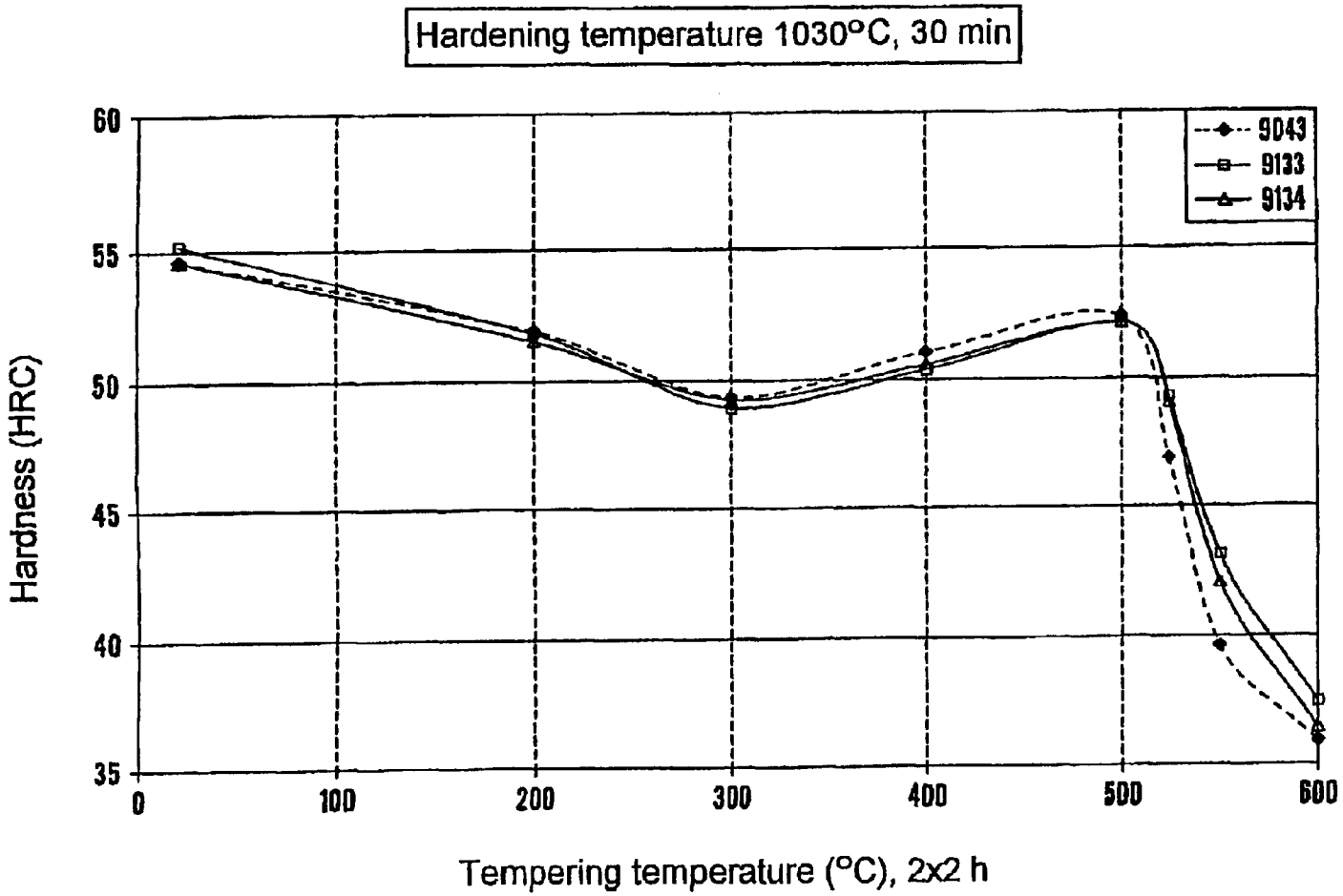
FIG. 3 shows the tempering graphs of the reference material and of a third series of steels manufactured as Q-ingots.

Tempering graphs of the first series of Q-ingots are shown in FIG. 1 and at a larger scale (the temperature range 500–600° C.) in FIG. 1A. Corresponding graphs are found in FIGS. 2 and 2A for the second series of Q-ingots. After low temperature tempering at 200° C./2×2 h the reference steel Q9043 achieved a hardness of 52 ERC. Also all other variants were lying at the same level +/−1 HRC. When tempering at the higher temperature range, 500–600° C., FIGS. 1A and 2A, the hardness of Q9043 drops more steeply at increased temperatures than all other variants. Q9133 and Q9134 exhibited equally high hardness after low temperature tempering at 200° C., 2×2 h as the reference material Q9043 but a higher tempering resistance than Q9043 when subjected to high temperature tempering, FIG. 3.

The effect of nitrogen on the polishability was examined since it was feared that an increased content of nitrogen might give rise to nitrides and hence to mattness of polished surfaces. Samples Q9133 and Q9134 of the invention having a relatively high content of nitrogen were compared with the reference material Q9043 having a lower content of nitrogen. Any nitrides, however, could not be found in the material of the invention and no difference concerning mattness etc. could be observed, neither in the soft annealed nor in the hardened and tempered condition.

For the ductility studies three un-notched impact test specimens per variant were cut out in the L-direction. The test specimens were heat treated (hardened and tempered) in the following way, including low temperature tempering as well as high temperature tempering.

Heat treatment 1: austenitizing at 1030° C./30 min, cooling in air and tempering at 250° C./2×2 h.

Heat treatment 2: austenitizing at 1030° C./30 min, cooling in air and tempering at 500° C./2×2 h.

Figure 4:
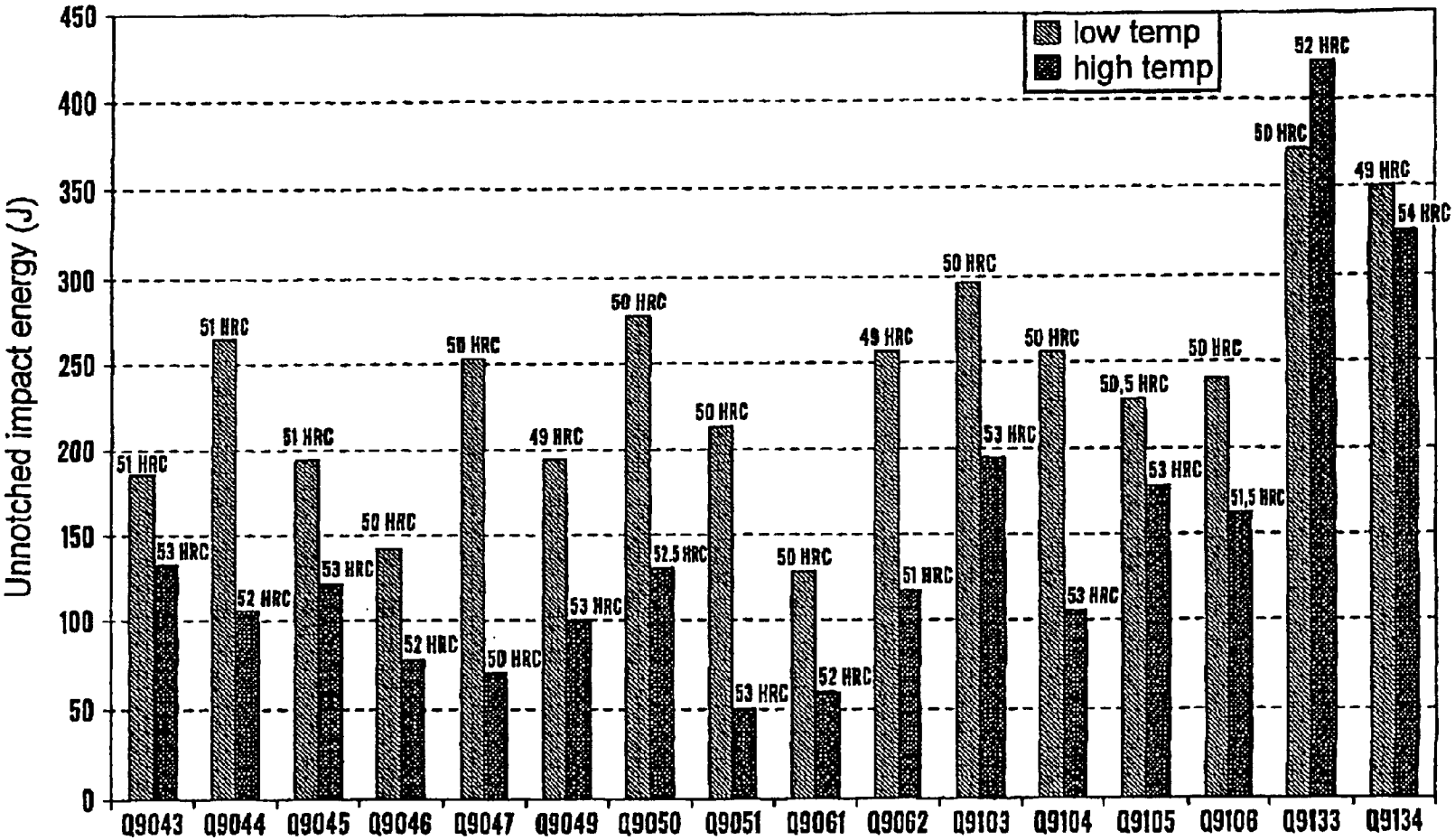
FIG. 4 is a bar chart which shows the ductility in terms of un-notched impact energy (J) of the examined steels after hardening and low temperature, and high temperature tempering, respectively.

In FIG. 4 the results are shown in terms of mean values measured with the three test specimens. In the drawing, also the achieved hardness is indicated. The drawing shows that

TABLE 1

Chemical composition, weight-%, total content of carbonitrides* (vol-%) according to Thermo-Calc, and PRE* value of examined steels.

| Alloy | Content of carbonitrides* | C | N | Si | Mn | Cr | V | Ni | Mo | PRE* |
|---|---|---|---|---|---|---|---|---|---|---|
| Q9043 | 1.3 | 0.36 | 0.026 | 0.83 | 0.47 | 13.9 | 0.32 | 0.18 | 0.12 | 14.3 |
| Q9044 | 1.6 | 0.34 | 0.033 | 0.25 | 0.63 | 14.1 | 0.3 | 1.11 | 0.43 | 15.6 |
| Q9045 | 1.9 | 0.34 | 0.03 | 0.81 | 0.64 | 14.1 | 0.32 | 1.08 | 0.43 | 15.4 |
| Q9046 | 1.3 | 0.34 | 0.022 | 0.19 | 0.65 | 13.4 | 0.29 | 1.65 | 0.44 | 14.9 |
| Q9047 | 1.5 | 0.35 | 0.034 | 0.2 | 0.6 | 13.8 | 0.29 | 1.1 | 0.12 | 14.3 |
| Q9049 | 0.23 | 0.3 | 0.067 | 0.23 | 0.66 | 13.1 | 0.34 | 0.78 | 0.44 | 15.5 |
| Q9050 | 0.23 | 0.29 | 0.067 | 0.2 | 0.68 | 12.9 | 0.33 | 1.62 | 0.64 | 15.9 |
| Q9051 | 0.36 | 0.29 | 0.073 | 0.22 | 0.65 | 13.2 | 0.44 | 0.8 | 0.44 | 15.4 |
| Q9061 | 2.1 | 0.35 | 0.068 | 0.19 | 0.58 | 15.0 | 0.28 | 1.39 | 0.44 | 16.7 |
| Q9062 | 0.14 | 0.26 | 0.074 | 0.15 | 0.6 | 13.4 | 0.25 | 1.57 | 0.65 | 16.7 |
| Q9103 | 0.16 | 0.27 | 0.058 | 0.19 | 0.51 | 13.2 | 0.3 | 1.71 | 0.32 | 15.1 |
| Q9104 | 0.15 | 0.28 | 0.071 | 0.22 | 0.6 | 13.4 | 0.32 | 1.24 | 0.32 | 15.4 |
| Q9105 | 0.28 | 0.27 | 0.063 | 0.18 | 0.59 | 14.3 | 0.31 | 1.23 | 0.32 | 16.3 |
| Q9106 | 0.47 | 0.27 | 0.081 | 0.20 | 0.62 | 14.9 | 0.32 | 0.84 | 0.32 | 16.9 |
| Q9133 | 0.37 | 0.22 | 0.10 | 0.31 | 0.54 | 13.3 | 0.34 | 1.33 | 0.36 | 15.7 |
| Q9134 | 0.45 | 0.18 | 0.13 | 0.32 | 0.51 | 13.3 | 0.33 | 1.35 | 0.36 | 16.1 |

*the content of carbonitrides was determined according to Thermo-Calc after hardening from 1030° C. and tempering at 250° C., 2 × 2 h. PRE = % Cr + 3.3 × % Mo + 20 × % N means the amounts of the elements forming base of the PRE value, which are dissolved in the matrix of the steel, after the said heat treatment.

Of the steel alloys of Table 1, the variants Q9103 and Q9105 through Q9134 are found within the frame of the widest ranges of the alloy contents according to the invention. The variant which most closely corresponds to the optimal composition is Q9133.

best ductility in terms of un-notched impact energy (J) was achieved with the alloys Q9133 and Q9134 of the invention. Q9103 had the next best ductility after low temperature as well as after high temperature tempering. However, it should be mentioned that Q-ingots, because of reasons which have to do with the manufacturing technique, may contain high contents of inclusions which reduce the ductility/toughness.

Figure 5:
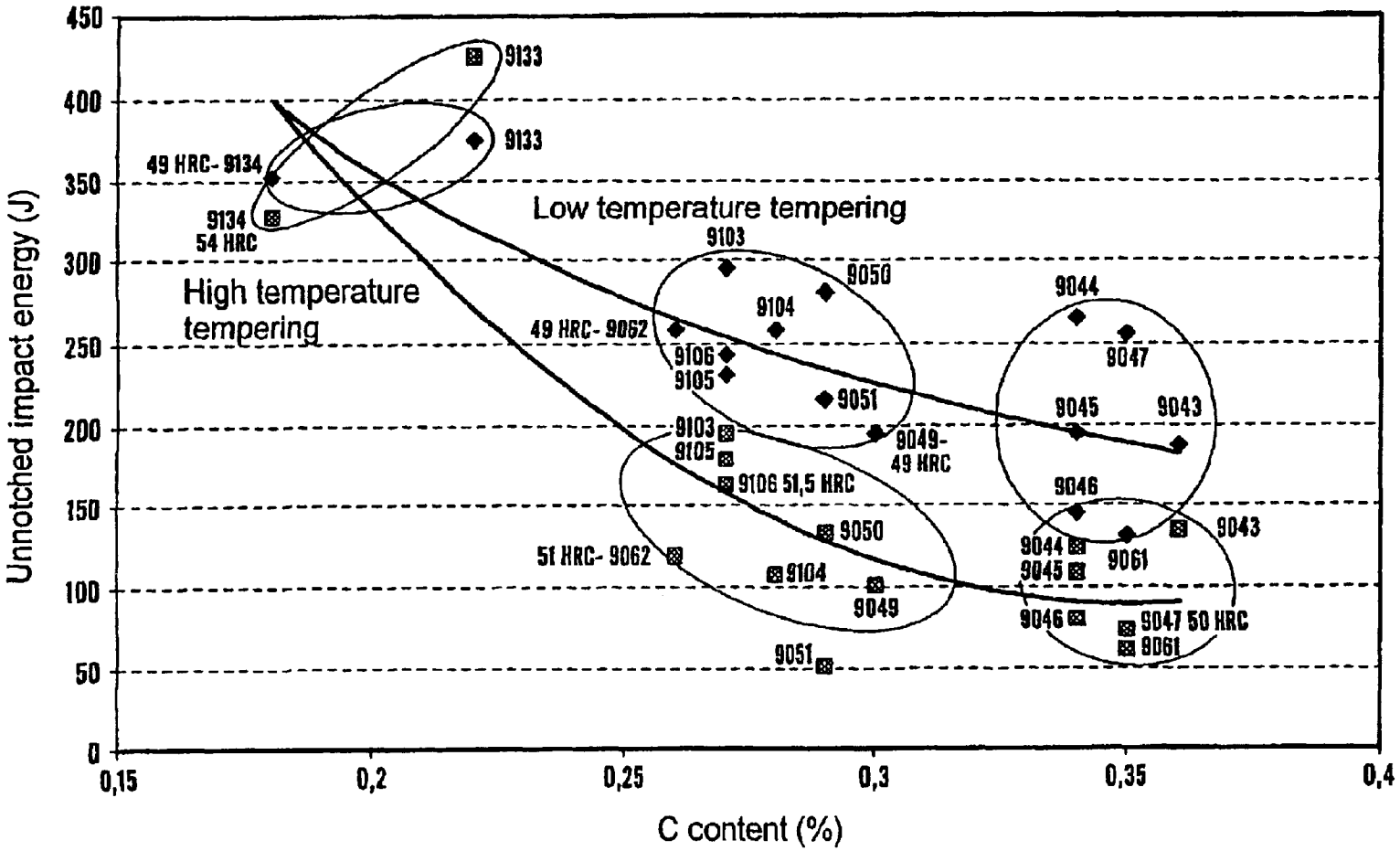
FIG. 5 is a chart which shows the ductility in terms of un-notched impact energy (J) versus the carbon content of the examined steels.
Figure 6:
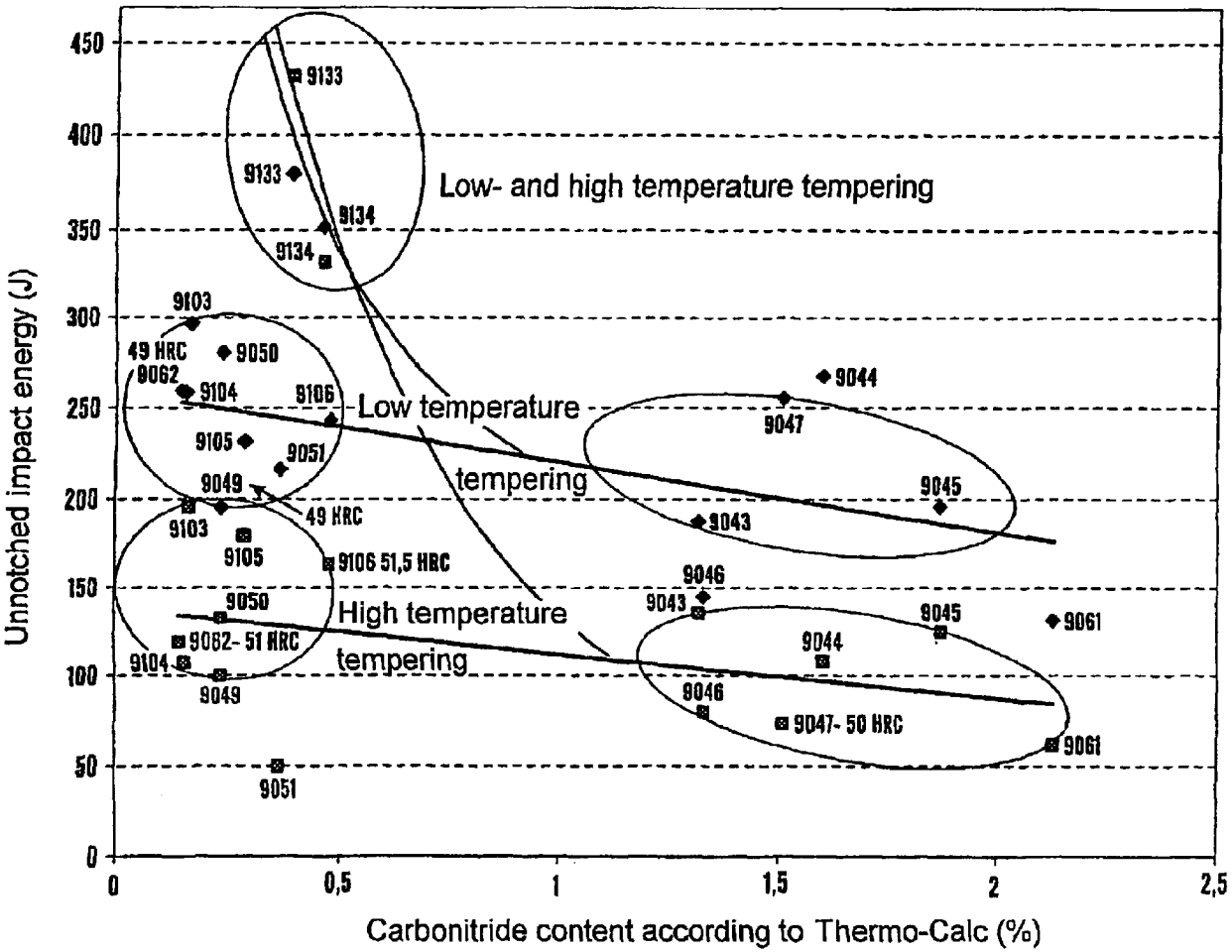
FIG. 6 is a chart which illustrates the ductility in terms of un-notched impact energy (J) versus the content of carbonitrides of the examined steels calculated according to Thermo-Calc.

The superior ductility in terms of un-notched impact energy (J) of the steels Q9133 and Q9134 of the invention, however, are so pronounced that the differences hardly can be referred to impurities in other materials. This is most clearly shown in the charts in FIG. 5 and FIG. 6, in which Q9133 and Q9134 form its own, clearly differing group. At a whole the impact toughness experiments show that not only a low content of carbides, FIG. 6, but also a lower content in comparison with other samples, is required for the achievement of best ductility in the low as well as the high temperature tempered condition of the steel, FIG. 5.

For the investigation of the corrosion resistance of the steels, polarisation graphs were made for all the steel alloys. The examined samples were low temperature tempered at 250° C., 2×2 h after hardening from 1030° C./30 min. The value of Icr (the critical current density) is shown in Table 2. The lower the Icr is, the better is the corrosion resistance. It is established that all the samples according to this test had a better corrosion resistance than the reference material, Q9043, including, with a good margin, the steels of the invention.

Figure 7:
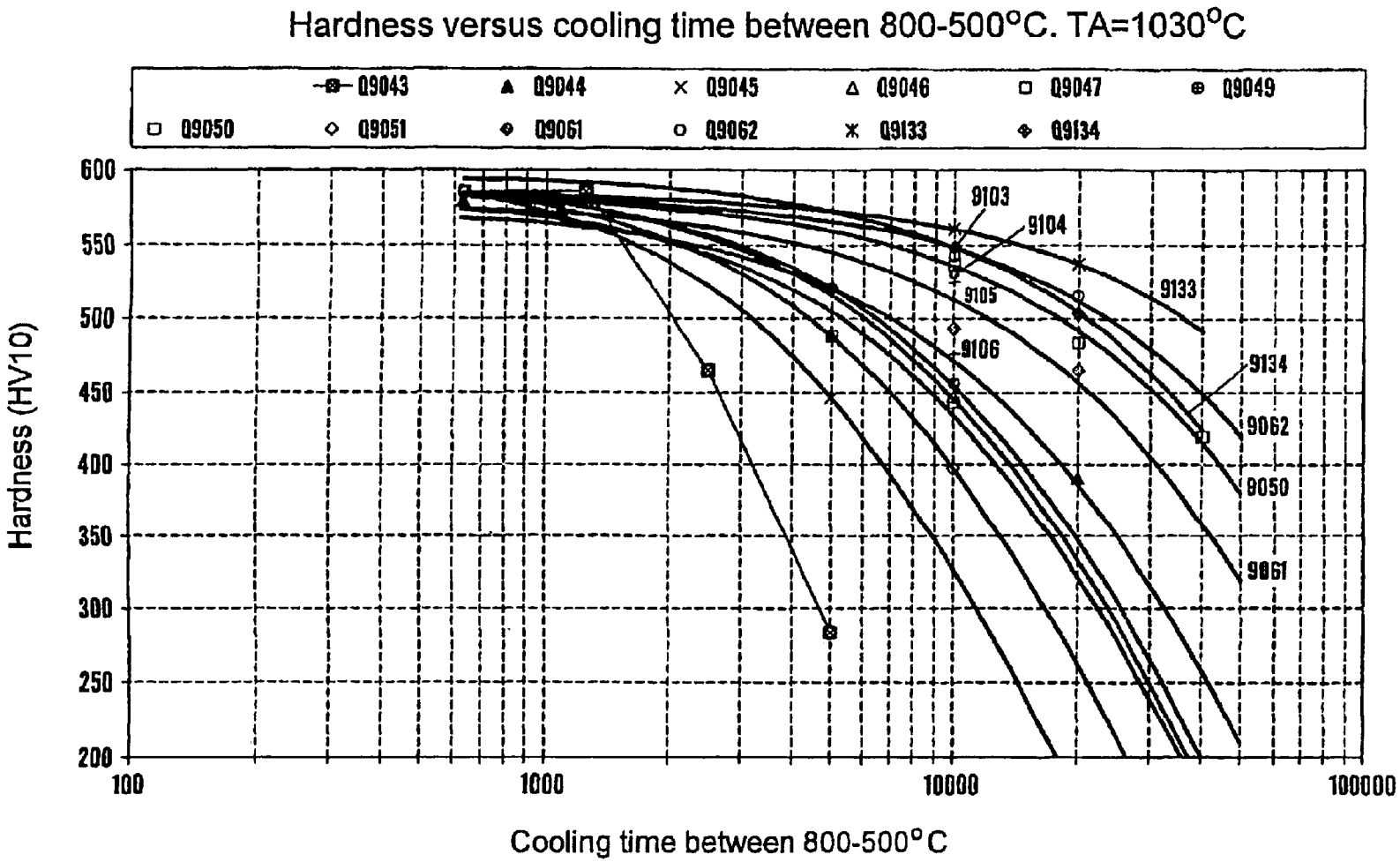
FIG. 7 is a chart which illustrates the hardenability of the steels in terms of hardness versus the cooling time between 800–500° C. after austenitizing treatment at 1030° C.

The hardenability, which is one of the most important features of the steel of the invention, was determined by measuring the hardness of small samples subjected to various cooling rates in dilatometer. In FIG. 7 the hardness is shown versus the cooling rate, establishing a measure of the hardenability. The reference material, Q9043, had the lowest hardenability, said material corresponding to said standardized steel of type SIS2314 and AISI420. Q9133, Q9062 and Q9134 had the best hardenability.

TABLE 2

Results from corrosion tests

| Q-ingot | Icr (mA/cm2) |
|---|---|
| 9043 = ref | 1.04 |
| 9044 | 0.57 |
| 9045 | 0.5 |
| 9046 | 0.4 |
| 9047 | 0.95 |
| 9049 | 0.5 |
| 9050 | 0.27 |
| 9051 | 0.5 |
| 9061 | 0.25 |
| 9062 | 0.2 |
| 9103 | 0.3 |
| 9104 | 0.4 |
| 9105 | 0.32 |
| 9106 | 0.5 |
| 9133 | 0.5 |
| 9134 | 0.5 |

What is claimed is:

1. Steel alloy for plastic molding tools, having a chemical composition consisting essentially of in weight-%, 0.16–0.27 C 0.06–0.13 N, wherein the total content of C+N shall satisfy the condition $0.3 \leqq C+N \leqq 0.4$ 0.1–1.5 Si 0.1–1.2 Mn 12.5–14.5 Cr 0.5–1.7 Ni 0.2–0.8 Mo 0.1–0.5 V optionally one or more of the elements S, Ca and O for the improvement of the cutability of the steel, in amounts up to max. 0.15% S max. 0.1% (100 ppm) Ca max. 0.01% (100 ppm) O, balance iron and unavoidable impurities.

2. Steel Alloy according to claim 1, wherein it contains at least 0.20 %. C.

3. Steel Alloy according to claim 2, wherein it contains max 0.25% C.

4. Steel alloy according to claim 1, wherein it contains about 0.10% N.

5. Steel alloy according to claim 1, wherein it contains max. 1.0% Si.

6. Steel alloy according to claim 5 wherein it contains max. 0.5% Si.

7. Steel alloy according to claim 1, wherein it contains max. 1.0% Mn.

8. Steel alloy according to claim 7, wherein it contains max. 0.8% Mn.

9. Steel alloy according to claim 8, wherein it contains max. 0.3–0.8% Mn.

10. Steel alloy according to claim 1, wherein it contains 13–14% Cr.

11. Steel alloy according to claim 1, wherein it contains 1.0–1.5% Ni.

12. Steel alloy according to claim 1, wherein it contains max. 0.6% Mo.

13. Steel alloy according to claim 12, wherein it contains 0.3–0.4% Mo.

14. Steel alloy according to claim 1, wherein it contains 0.25–0.40% V.

15. Steel alloy according to claim 1, wherein it contains 0.22% C 0.10% N 0.3% Si 0.5% Mn 13.5% Cr 1.2% Ni 0.35% Mo 0.35% V.

16. Steel alloy according to claim 1, wherein it contains 0.07–0.15% S but no intentionally added amount of calcium.

17. Steel alloy according to claim 1, wherein it contains 0.025–0.15% S

3–75 ppm Ca, and

10–40 ppm O.

18. Steel alloy according to claim 17, wherein it contains 0.025–0.15% S 5–40 ppm Ca, and 10–40 ppm O.

19. Steel alloy according to claim 1, wherein said steel has been hardened from 1020° C. followed by tempering at 250° C., 2×2 h, such that the elements Or, Mo and N are in solid solution in the steel matrix and are not bound in the form of carbides, nitrides, and/or carbonitrides, and the steel has a PRE value which is at least 14.8, the PRE value being expressed through the formula:

$$PRE = \%\ Cr(s) + 3.3 \times \%\ Mo(s) + 20 \times \%\ N(s),$$ were Cr(*s*), Mo(*s*) and N(*s*)

means Cr, Mo and N in solid solution in the matrix of the steel.

20. Steel alloy according to claim 19, wherein the steel has a PRE value which is at least 15.0.

21. Plastic molding tool wherein it is made of a steel alloy according to claim 1 and wherein said steel, after hardening from 1020–1030° C. followed by tempering at either 200–250° C. or at 500–520° C., has a micro structure, the matrix of which consists substantially of tempered martensite and, in the matrix of the steel, 0.3–1.0 vol-% primary precipitated carbonitrides consisting essentially of M(C, N) carbonitrides.

22. Tough hardened blank in the form of a bar, rod, plate or block for plastic molding tools, wherein it is made of a steel alloy according to claim 1, and wherein said steel, after heat treatment comprising austentizing at 1020–1030° C., followed by cooling to room temperature and tempering at 540–625° C., such that the steel matrix has a hardness of 35–45 HRC and a micro structure, the matrix of which consists substantially of tempered martensite and, in the matrix of the steel, 0.3–1.0 vol-% primary precipitated carbonitrides consisting essentially of M(C, N) carbonitrides.

* * * * *